United States Patent [19]

Galletti

[11] 3,991,951

[45] Nov. 16, 1976

[54] APPARATUS FOR FEEDING COILS OF STRIP TO AN UNWINDING STATION

[75] Inventor: Cesare Galletti, Milan, Italy

[73] Assignee: Innocenti Santeustacchio S.p.A., Italy

[22] Filed: Dec. 24, 1975

[21] Appl. No.: 644,182

[30] Foreign Application Priority Data

May 2, 1975 Italy ..... 22957/75

[52] U.S. Cl. ..... 242/78.6; 242/66; 242/79

[51] Int. Cl.[2] ..... B21C 47/16

[58] Field of Search ..... 242/78.6, 78.7, 79, 242/84, 66

[56] References Cited

UNITED STATES PATENTS

| | | | |
|---|---|---|---|
| 2,756,943 | 7/1956 | Sieger | 242/79 |
| 3,150,706 | 9/1964 | O'Brien | 242/78.6 X |
| 3,186,655 | 6/1965 | Huffington | 242/79 |
| 3,695,542 | 10/1972 | Briggs | 242/78.6 |

*Primary Examiner*—Edward J. McCarthy
*Attorney, Agent, or Firm*—Weingarten, Maxham & Schurgin

[57] ABSTRACT

Successive coils of strip are fed to an unwinding station by a transfer carriage supporting at least two driven coil support rollers on a vertically movable coil support, support for a tight or slack coil during a preliminary unwinding being provided by retractable arms carrying idler rollers for rotatably supporting a coil, the arms when extended supporting the idler rollers between the driven rollers. A further pair of retractable arms at the unwinding station support further idler rollers which when extended are located at the same height as idler rollers of the first retractable arms, with one of the driven rollers being located between two of the idler rollers so that, upon lowering the carriage-mounted support the coil originally supported by the driven rollers is caused to rotate onto the idler rollers and is thus transferred from the driven rollers to the idler rollers.

4 Claims, 9 Drawing Figures

APPARATUS FOR FEEDING COILS OF STRIP TO AN UNWINDING STATION

BACKGROUND OF THE INVENTION

The present invention refers to apparatus for feeding successive coils of strip to an unwinding station, particularly an unwinding station of a tandem rolling mill, comprising a transfer carriage, a vertically movable support, actuator means for moving the support vertically, at least two driven rollers mounted on the support for supporting a coil of strip, the driven rollers being radially spaced apart and rotating around respective parallel axes, and means for moving the transfer carriage from a coil entry station to an unwinding station.

A known method of feeding successive coils of strip to an unwinding station, specifically to an unwinding station of a tandem rolling mill, employs an apparatus consisting of a transfer carriage movable between an entry station and the unwinding station, a double-acting piston-cylinder actuator with a vertical axis mounted on the carriage, a fork-shaped coil support having two vertical arms carrying driven rollers at their upper ends, the support being carried and guided for movement vertically by the transfer carriage. At the entry station the fork-shaped support is lifted by its piston-cylinder actuator to receive and support a coil of metal strip on its driven rollers. Following this, the support is lowered by means of its actuator and the transfer carriage is moved linearly until it reaches a position adjoining the unwinding station, where it is arrested and a preliminary unwinding of the strip is effected. A portion of this strip is manipulated in a known fashion and fed for example into the first stand of a rolling mill or held in waiting until the terminal portion of the strip from the coil previously fed to the unwinding station has been exhausted.

An unwinding station generally consists of a support carriage hereinafter called a "coil box", having two vertical arms with idler rollers mounted on their upper ends and a double-acting oleodynamic piston-cylinder actuator with a vertical axis arranged to lift and lower the vertical arms or the whole coil box. The idler rollers are radially spaced apart and rotatable about respective axes parallel to the axes of rotation of the driven rollers of the transfer carriage. In their upper position the idler rollers of the coil box are lower than the driven rollers of the transfer carriage coil support when the support actuator is retracted. In a position adjacent the coil box and downstream from this in relation to the feed direction of the coils, a number of damper rollers are provided, supported in an arcuate arrangement such that the rollers may circumscribe a portion of the external surface of a coiled strip loaded onto the coil box.

It is moreover known that the coils of strip which arrive at the entry station may have the strip wound either in a tight or a slack fashion. When a tightly wound coil is handled to the unwinding station, the coil is supported by means of a pair of expansible mandrels, rotatably supported by a supporting structure conveniently positioned at the unwinding station, the mandrels being inserted by known oppositely acting means into the hollow cylindrical core of the coil. When a slack coil is fed to the unwinding station, then on account of the non-uniform nature of the strip unwinding process, expansible mandrels are not used to support the coil, but the coil is simply supported by the idler rollers of the coil box and laterally restrained by containing plates brought up to the opposite sides of the coil.

In an apparatus of the aforementioned kind, when slack coils of strip are to be fed to an unwinding station, it is necessary to transfer a slack coil from the transfer carriage, held in the preliminary unwinding position, to the coil box.

At present the transfer of such slack coils is effected by means of an angular displacement of the whole transfer carriage around one of its longitudinal axes parallel to the axis of rotation of the driven rollers of the fork-shaped coil support. Following this angular displacement, the coiled strip falls, with a partial rotation about its longitudinal axis, onto the idler rollers of the coil box, its descent being arrested by the damper rollers referred to above. At this point, in the case of a slack coil, the lateral containing plates will have been brought up to the coil and the unwinding of the strip may be completed.

This known system for feeding a slack coil to a strip unwinding station suffers from the considerable technical drawback that the transfer of the coils by falling from the transfer carriage to the coil box may cause damage to the strip to be rolled considerably straining also the structure of the coil box and of the damper rollers.

The object of the present invention is to provide a coil feed apparatus which enables a slack coil of strip to be fed conveniently to an unwinding station, while ameliorating the drawbacks associated with previously known apparatus of this type.

SUMMARY OF THE INVENTION

According to the invention there is provided an apparatus of the aforesaid type, characterised in that the apparatus includes, at the unwinding station, at least one retractable arm having at one end an idler roller for supporting a coil while permitting rotation thereof, the retractable arm being selectively movable between a retracted position in which the respective idler roller is disposed at one side of the transfer carriage when this carriage is at the unwinding station and an extended position in which the idler roller is located in a space between the driven rollers when the transfer carriage is at the unwinding station and at least one device supporting a further idler roller for rotatably supporting a coil, the device being movable between a retracted position in which it does not interfere with the movement of the transfer carriage and an extended position in which the idler roller is substantially at the same height as idler roller of the retractable arm in the extended position of the latter, one of the driven rollers being positioned between the idler rollers so that, upon lowering the support by its actuator means, a coil originally supported by the driven rollers is caused to rotate towards the idler rollers and is thus transferred from the driven rollers to the idler rollers.

Among the advantages obtained by this invention is the fact that tightly wound coils are directly and easily carried from the transfer carriage to the unwinding station and then put into use by the expansible support mandrels holding the retracted idler rollers.

When the expansible support mandrels have been inserted into the hollow core of the tight coil, the transfer carriage may be returned to the entry station to receive a successive coil.

In the case of a slack coil, after the transfer carriage has reached the unwinding station, the idler rollers are moved to the position for receiving the slack coil and then, by means of a slow lowering of the driven roller support of the transfer carriage, the slack coil is gently transferred to the idler rollers without falling, after which containing plates are brought together with the coil and the unwinding of the coil may be continued and carried to its close. In this manner the drawbacks associated with the previously known apparatus are avoided or reduced.

BRIEF DESCRIPTION OF THE DRAWINGS

The invention will now be described in more detail, purely by way of example, with reference to the accompanying drawings, wherein.

DETAILED DESCRIPTION OF THE ILLUSTRATED EMBODIMENT

Figure 1:
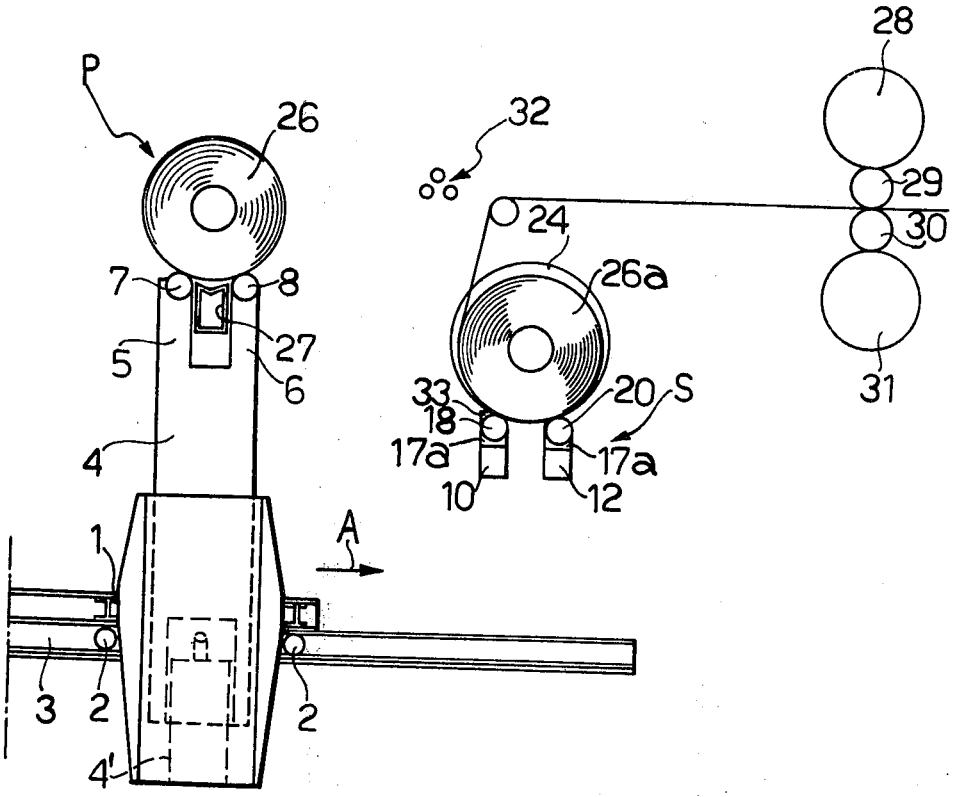
FIGS. 1 to 5 show, in diagrammatic form, the feeding of a slack coil of strip from an entry station to a coil unwinding station, using an apparatus according to one embodiment of the invention.
Figure 2:
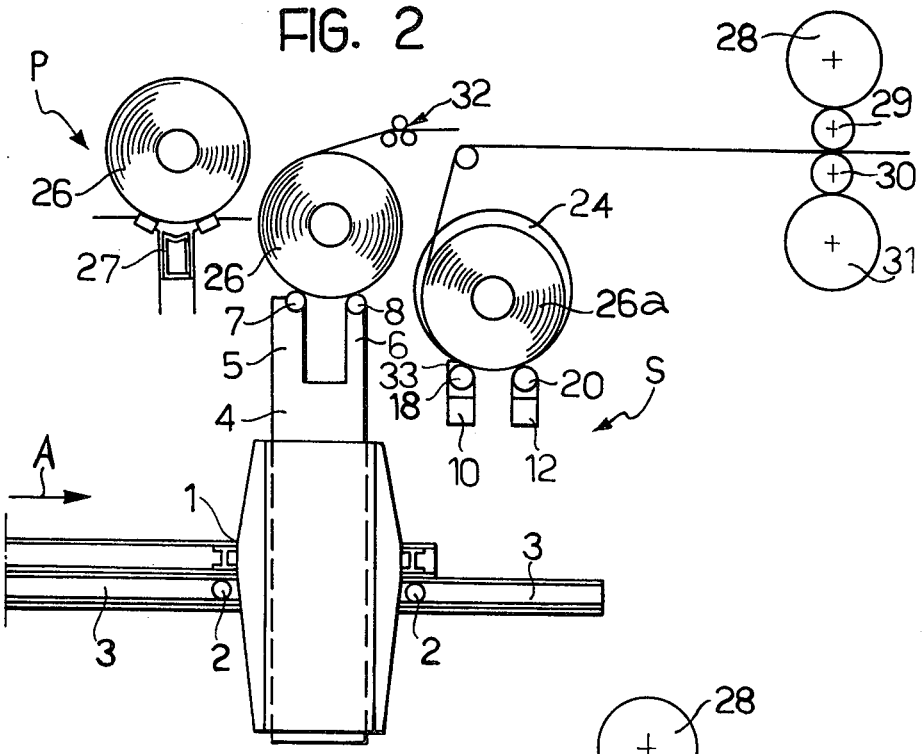
Figure 3:
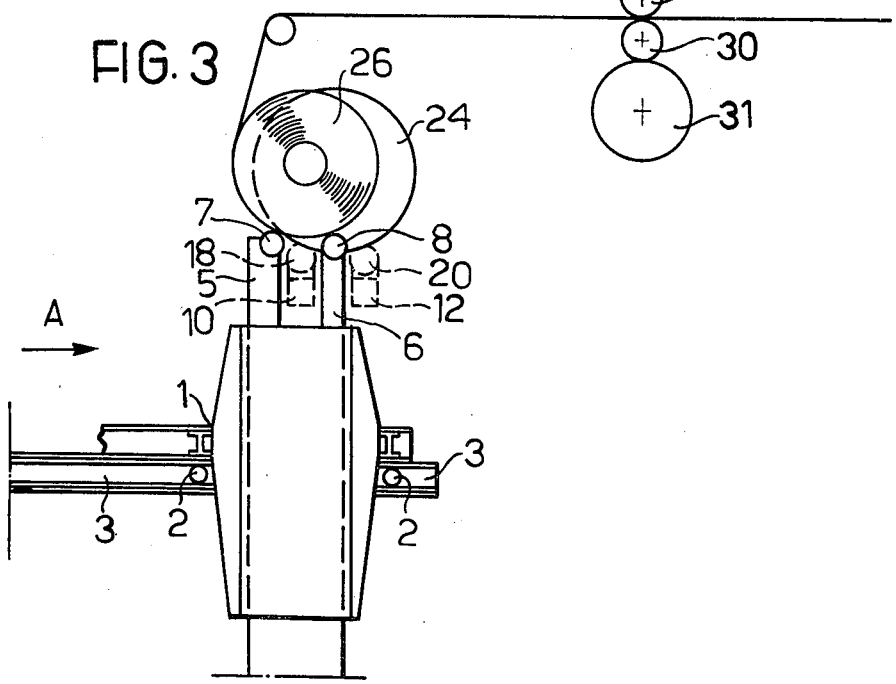
Figure 4:
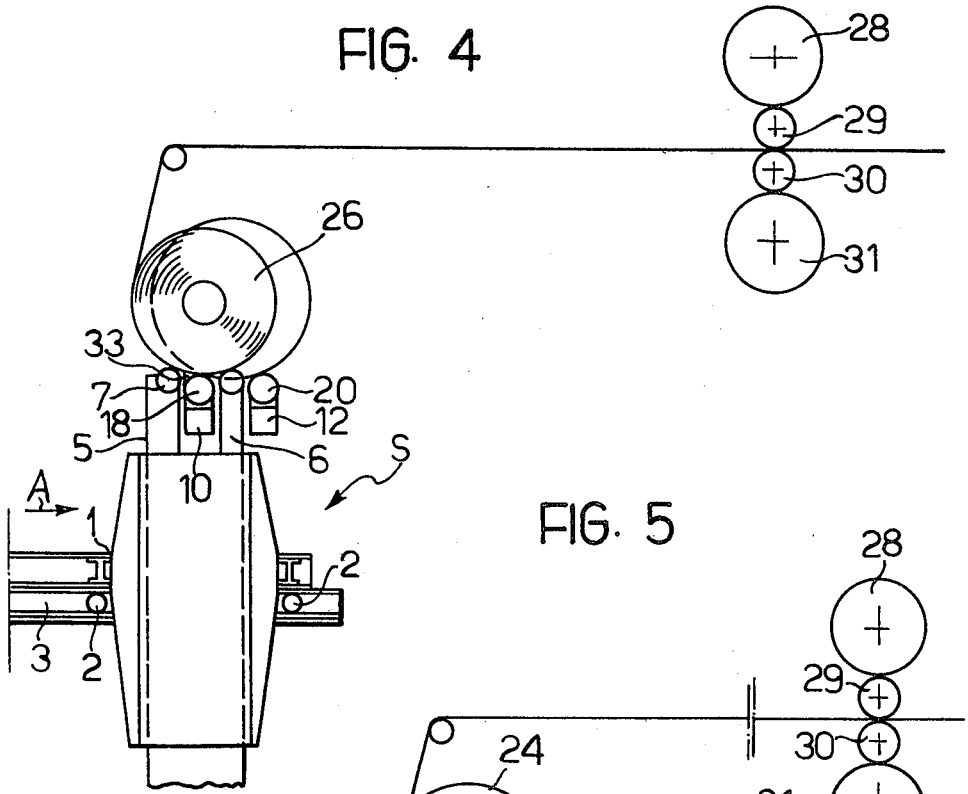
Figure 5:
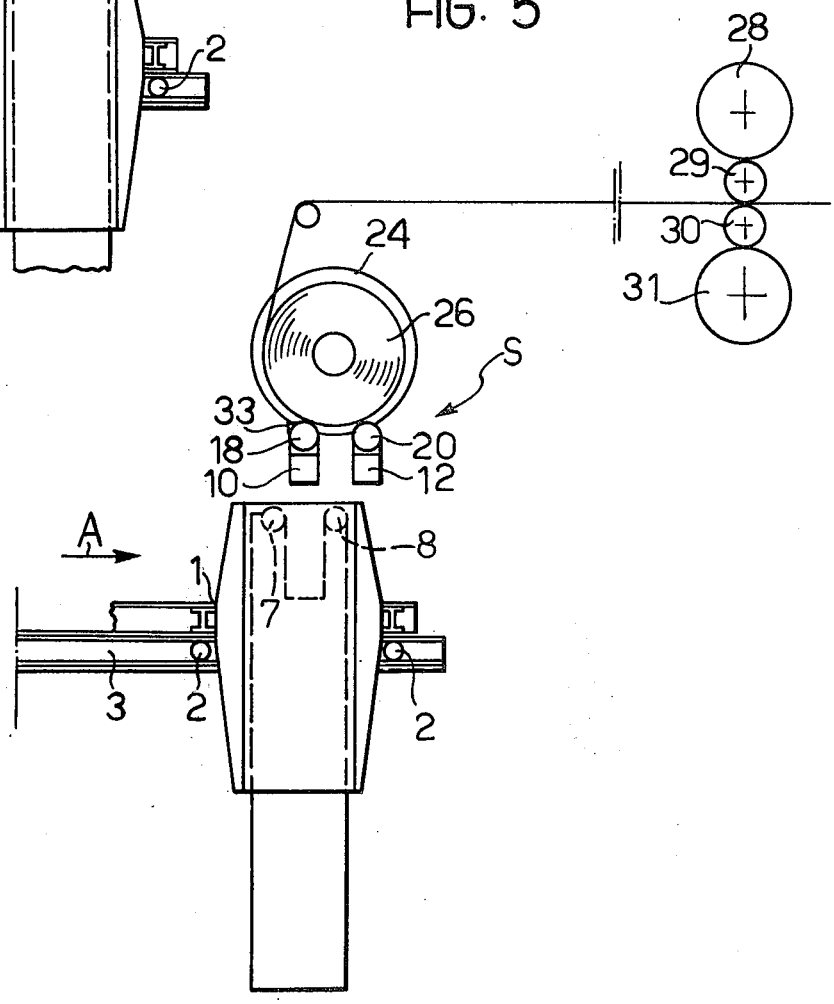

An apparatus according to the invention to feed successive coils of metal strip from an entry station P to an unwinding station S, consists of a transfer carriage 1 fitted with wheels 2 which roll on tracks 3, consisting for example of I-section rails, which extend in a straight line from the entry station P to a position downstream from the unwinding station S with reference to the coil feed direction indicated by arrow A. On the carriage 1 there is mounted in known manner a support 4 which is movable vertically by operation of a double-acting piston-cylinder actuator 4', shown diagrammatically in FIG. 1, having a vertical axis, and also carried by the carriage 1.

Figure 6:
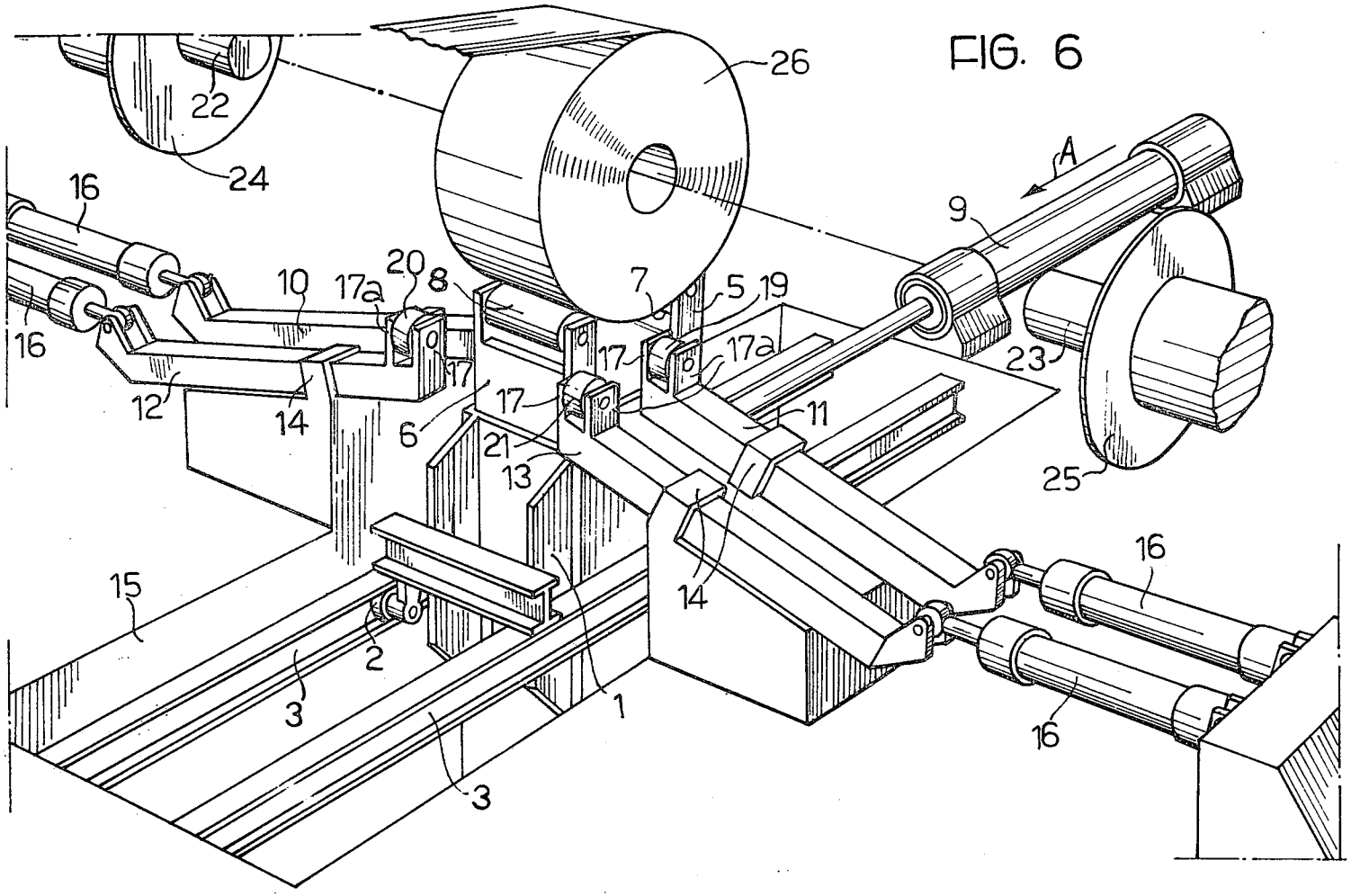
FIGS. 6 to 8 show in perspective the same apparatus as in FIGS. 1 to 5 at the point of transfer of a slack coil from the transfer carriage to an unwinding station.
Figure 7:
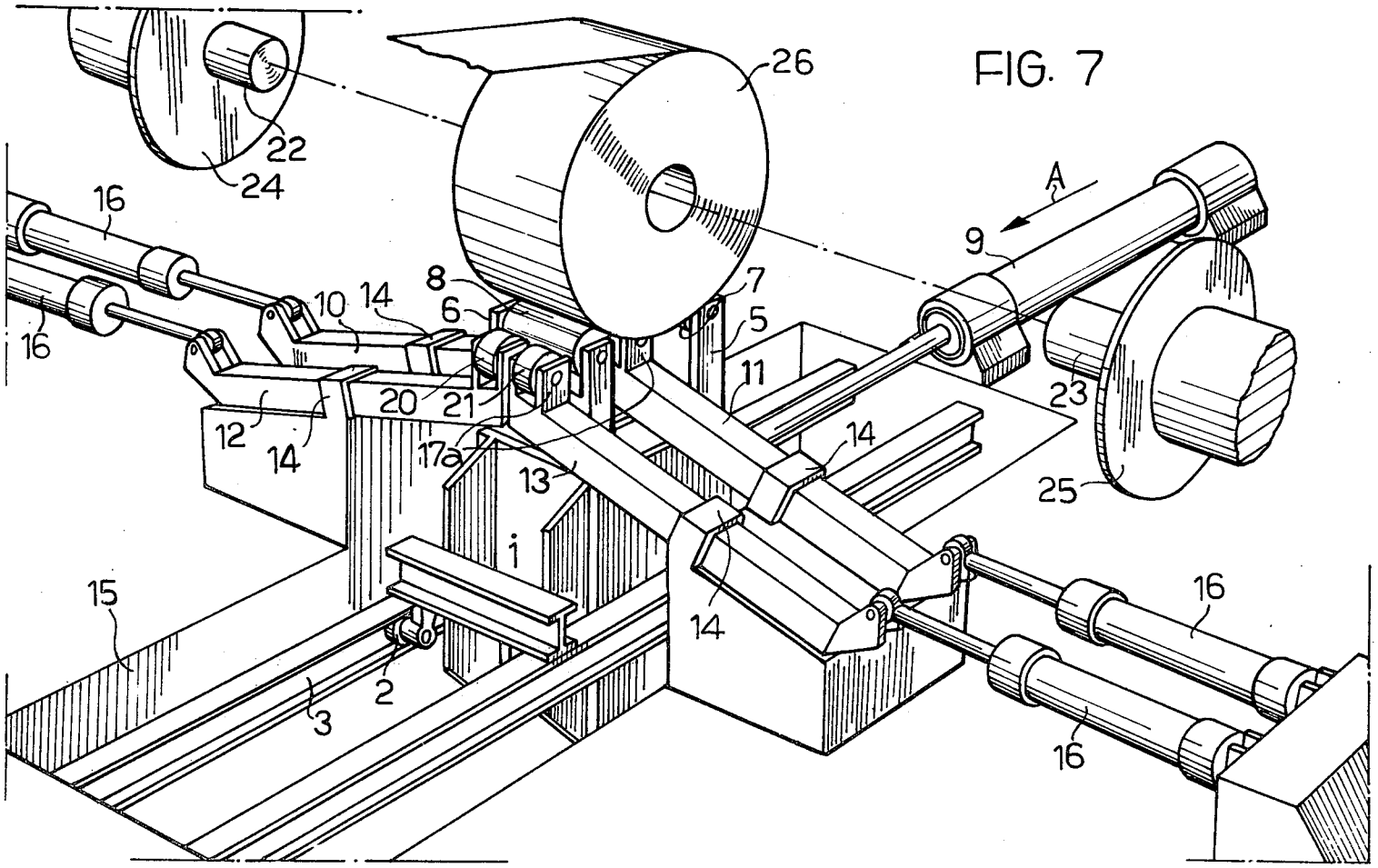
Figure 8:
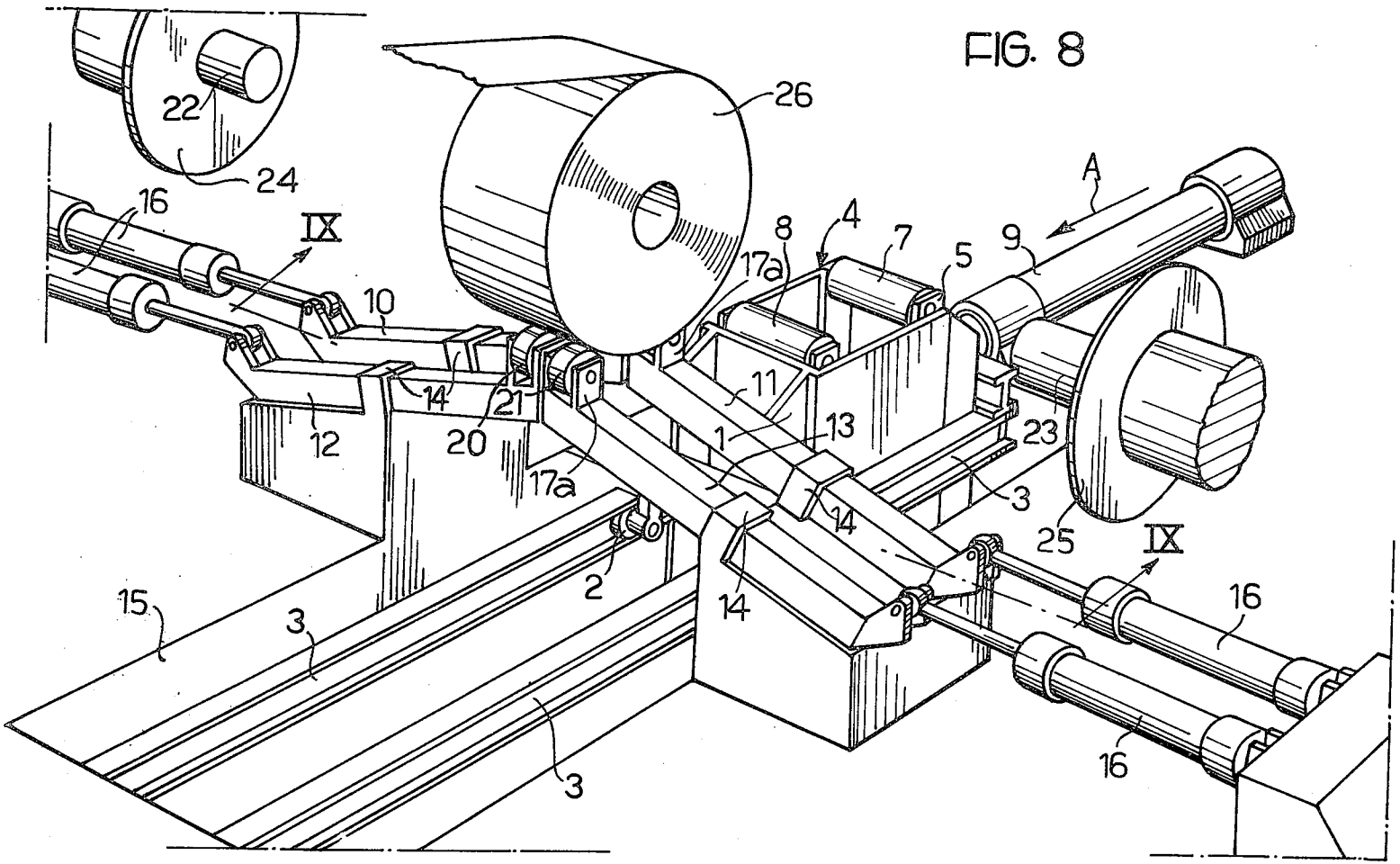

The support 4 is fork-shaped with two upper vertical arms 5, 6 supporting rotatably respective motor-driven rollers 7, 8 the axes of rotation of which are parallel, horizontal and perpendicular to the direction of advance A. A double-acting piston-cylinder actuator 9 (FIG. 6) with a horizontal axis is disposed upstream of the coil entry station P for effecting linear displacement of the carriage 1.

Two pairs of retractable arms 10, 11 and 12, 13 (FIG. 6) are placed at the unwinding station S, the arms of each pair being on opposite sides of the tracks 3. The arms 10, 12 and 11, 13 on each side of the tracks 3 are parallel and perpendicular to the coil feed direction A, and are inclined upwards towards the adjacent track 3. The arms 10, 11 and 12, 13, which have square transverse cross sections, are supported for longitudinal sliding movement by respective guide sleeves 14 attached to fixed supports which project upwardly from the sides of a pit 15 in which the tracks 3 are laid out and in which transfer carriage 1 moves.

The end of each of the arms 10, 11 and 12, 13 remote from the pit 15 is articulated to a respective double-acting piston-cylinder actuator 16, whilst at the other end, adjacent the pit 15, each said arm is fitted with a pair of vertical lugs **17, 17*a*. The pairs of vertical lugs 17, 17*a* on the arms 10, 11, 12 and 13 support respective idler rollers 18, 19, 20 and 21 having horizontal axes of rotation parallel to the axes of rotation of the driven rollers 7, 8. The size of each retractable arm measured in direction of coil advance A is less than the distance between the vertical arms 5, 6 of the fork-shaped coil support 4 of the transfer carriage 1**.

Figure 9:
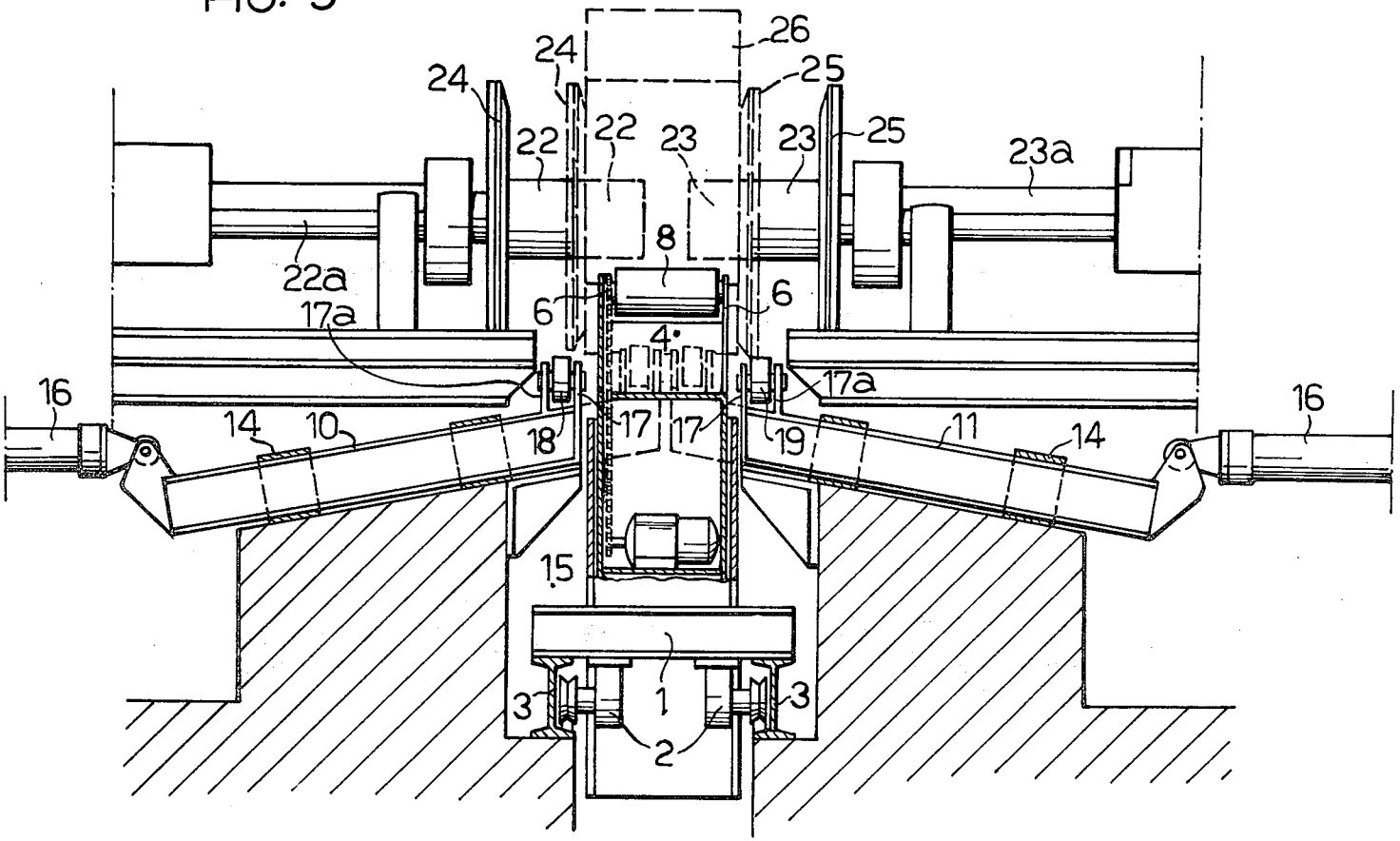
FIG. 9 is a section taken along line IX—IX of FIG. 8.

Two expanding coaxial type expansible mandrels 22, 23 (FIG. 9) are supported by known means (not shown), at the unwinding station S. These mandrels 22, 23, which are movable horizontally in a direction perpendicular to the direction of advance A of the coils, are capable of being brought together or moved apart, for example by means of respective oleo-dynamic actuators **22*a* and 23*a*. Two vertical plates 24, 25**, also capable of being reciprocally brought together or moved apart by known means (not shown) are used to contain a coil of strip during the unwinding operation.

OPERATION

The operation of the apparatus described above is as follows. Successive coils of strip 26 are fed by known means to entry station P by means of a support bar 27 called a walking beam. The transfer carriage 1 is at the entry station P and its fork-shaped support 4 is in its lowermost, retracted, position (not shown). At the unwinding station S a coil **26*a* is being unwound and the strip of which it consists is about to run out. This strip is drawn through a rolling mill of which the first rolling stand is shown diagrammatically by the rollers 28–31 in FIGS. 1 to 5**.

In order to feed a new roll, the fork-shaped support 4 of the transfer carriage 1 is lifted until the driven rollers 7, 8 support a new coil 26. The bar 27 is then retracted by a predetermined length and the fork-shaped support 4 is lowered whilst transfer carriage 1 is advanced by means of the actuator 9 towards the unwinding station S. Upstream of the unwinding station S, and in proximity to the latter, the tranfer carriage 1 is arrested and a preliminary unwinding of the strip itself is effected. Upon such preliminary unwinding the leading portion of the strip on the coil 26 is first handled, as known per se, by a group of straightening rollers indicated generally by 32 and then fed between the rolls 29, 30 of the first rolling stand once the strip of the preceding coil **26*a*** has been exhausted.

When coil **26*a* has been completely exhausted the two pairs of retractable arms 10, 11 and 12, 13 are completely retracted to the sides of the tracks 3 and the transfer carriage 1 is advanced by the actuator 9 until it occupies the unwinding station S, whilst the corresponding fork-shaped support 4 is finally lowered to such an extent that the roll 26 supported thereby does not interfere in its movement with the expansible mandrels 22, 23**, these also being restrained in their retracted positions.

In the case where said coil 26 is a tight coil (that is to say, consisting of a tightly wound strip) the fork-shaped support 4 is now lifted until the axis of the coil 26 coincides with the axis of the mandrels 22, 23. The mandrels 22, 23 are then inserted into the opposite ends of the hollow core of the coil 26 and expanded, the plates 24, 25 coming into contact with the opposite sides of the coil. As the unwinding of this coil proceeds the transfer carriage 1 may be returned to the entry station P.

In the case where the coil 26 consists of loosely coiled strip, then when the transfer carriage 1 is arrested at the unwinding station S, its arms 10, 11 and 12, 13 are chosen so that when the arms are fully extended the idler rollers 18, 19 on the arms 10, 11 are interposed between the driven rollers 7, 8 of the fork-shaped support 4, whilst the idler rollers 20, 21 on the arms 12, 13 are positioned downstream of the driven roller 8. At this point the fork-shaped support 4 is very slowly lowered. During this lowering the coil 26 (FIGS. 4 and 5) first rests on the driven rollers 7, 8 and the idler rollers 18, 19, then, after a slight angular displacement, on the idler rollers 18, 20 and 19, 21 and the driven roller 8, and lastly only on the two pairs of idler rollers 18, 20 and 19, 21. While the slack coil is supported only by the two pairs of idler rollers 18, 20; 19, 21 and while the unwinding of the strip from the coil 26 proceeds the fork-shaped support 4 reaches its lowermost position and the transfer carriage 1 may be returned to the entry station P. In order to facilitate and guarantee the transfer of the coil 26 from the driven rollers 7, 8 to the idler rollers 18, 20; 19, 21 a vertical projection 33 is provided on the arms 10, 11 carrying the idler rollers 18, 19 on the side of the respective rollers 18, 19 facing towards the direction of advance A of the coils.

Although a piston-cylinder actuator 9 is employed in the illustrated embodiment for the movement of transfer carriage 1, it will be apparent that any powered actuator means may be employed for this purpose. Moreover, instead of using two pairs of opposed retractable arms at the unwinding station S only two individual opposing arms may be used, each of which fitted with idler rollers having an axial length greater than that illustrated. The retractable arms may be movable in horizontal direction rather than in a direction inclined to the horizontal as in the illustrated embodiment, the only requirement being a sufficient space between the driven rollers 7, 8 so as to permit the insertion therebetween of idler rollers supported by a retractable arm.

The apparatus according to the invention may be completely automated by including means, known per se, to sense when a coil of strip is tightly or loosely wound.

I claim:

1. Apparatus for feeding successive coils of strip to an unwinding station, particularly an unwinding station of a tandem rolling mill, comprising:

a transfer carriage, a vertically movable support, actuator means for moving said support vertically, at least two driven rollers mounted on said support for supporting a coil of strip, the said driven rollers being radially spaced apart and rotating around respective parallel axes, and means for moving the said transfer carriage from a coil entry station to an unwinding station, wherein the improvement consists in:

a. at least one retractable arm at the unwinding station having at one end an idler roller for supporting said coil while permitting rotation thereof, b. means for selectively moving said retractable arm between a retracted position in which the respective idler roller is disposed at one side of said transfer carriage when this carriage is at the unwinding station and an extended position in which said idler roller is located between said driven rollers when the transfer carriage is at the unwinding station, c. at least one device supporting a further idler roller for rotatably supporting said coil, said device being movable between a retracted position in which it does not interfere with the movement of the transfer carriage and an extended position in which said idler roller is at substantially the same height as idler roller of said retractable arm in the extended position of the latter, and d. one of the said driven rollers being positioned between said idler rollers so that, upon lowering the said support by its actuator means, a coil originally supported by the driven rollers is caused to rotate towards the idler rollers and is thus transferred from the driven rollers to said idler rollers.

2. The apparatus defined in claim 1, wherein there are provided two said retractable arms, the arms of said pair of retractable arms being positioned on opposite sides of said transfer carriage when the latter is at the unwinding station.

3. The apparatus defined in claim 2, wherein each of said retractable arms is inclined to the horizontal.

4. The apparatus defined in claim 2 wherein the device which supports said further idler roller consists of a pair of opposing retractable arms each having an idler roller at one end, the said retractable arms being parallel to the pair of first-mentioned retractable arms and being disposed downstream of the latter with respect to the direction of feed of the coils to the unwinding station.

* * * * *